US007172132B2

(12) United States Patent
Proffitt et al.

(10) Patent No.: US 7,172,132 B2
(45) Date of Patent: Feb. 6, 2007

(54) BALANCED UTILITY LOAD MANAGEMENT

(75) Inventors: Jerry L Proffitt, Wabash, IN (US); Michael A. Roher, Fort Wayne, IN (US)

(73) Assignee: Carrier Corporation, Farmington, CT (US)

( * ) Notice: Subject to any disclaimer, the term of this patent is extended or adjusted under 35 U.S.C. 154(b) by 306 days.

(21) Appl. No.: 10/912,297

(22) Filed: Aug. 5, 2004

(65) Prior Publication Data

US 2006/0027669 A1 Feb. 9, 2006

(51) Int. Cl.

| | |
|---|---|
| ***G05D 23/12*** | (2006.01) |
| ***F24F 11/053*** | (2006.01) |
| ***H02J 1/00*** | (2006.01) |
| ***G06F 1/26*** | (2006.01) |

(52) U.S. Cl. ..... 236/1 C; 62/158; 165/267; 307/39; 713/321

(58) Field of Classification Search ..... 236/1 C, 236/46 R, 46 F; 62/126, 157, 158; 165/267; 307/39; 700/295, 291, 297; 713/320, 321, 713/323

See application file for complete search history.

(56) References Cited

U.S. PATENT DOCUMENTS 4,208,593 A * 6/1980 Sullivan ..... 307/35

* cited by examiner

*Primary Examiner*—Chen Wen Jiang
(74) *Attorney, Agent, or Firm*—Wall Marjama & Bilinski LLP

(57) ABSTRACT

A method and apparatus for controlling the operation of an air conditioning system and a plurality of auxiliary devices, with both the air conditioning system and the auxiliary devices being adapted to operate in a setback condition. The auxiliary devices are operated in a setback condition in response to the operation of the setback operation of the air conditioning system such that, generally, the auxiliary devices are operated in a setback condition when the air conditioning system is operating in a non-setback condition and vice versa so as to thereby achieve load balancing. In addition, the auxiliary devices can, at the same time, be operated in the setback mode on the basis of duty cycle.

16 Claims, 3 Drawing Sheets

BALANCED UTILITY LOAD MANAGEMENT

BACKGROUND OF THE INVENTION

This invention relates generally to setback thermostats and, more particularly, to a method and apparatus for balancing load management by the use of both primary and auxiliary setback mechanisms.

In an effort to reduce peak load requirements during extreme temperature conditions, utility companies have instituted utility load management programs whereby a user may be offered reduced rates if the user is willing to "setback" their thermostats during such period of high energy use. This process occurs automatically by the utility communicating directly with the users thermostats, and also includes provisions for the user to override such a setback condition if he so desires. Unless the user is overriding the system, the time periods in which the user's thermostat is "setback", is therefore based only on the demand to the utility.

In addition to the procedure of setting back the thermostat for HVAC (i.e. heating, ventilating and air conditioning) systems, provision is also made for setback of energy that is provided to run non-HVAC, auxiliary devices such as pool pumps, pool heaters, hot water heaters, hot tubs and the like. These devices do not have thermostats and may or may not have temperature sensors. Accordingly, the common approach for setback in these devices is on a duty cycle basis. For example, a 50% duty cycle may be imposed whereby the device is alternately turned off and turned on for equal periods of time with the effect that over the entire period, the device is only on half the time.

From the above description it will be recognized that, since there is no coordination between the setback times for HVAC systems and for the auxiliary devices, there will be periods when neither the HVAC nor the auxiliary devices are in a setback condition. There will also be times when both the HVAC systems and the auxiliary devices are in a setback mode. The result is that the total time in which the various systems are in a setback condition is very non-uniform, thereby resulting in a less uniform demand to the utility. This condition is undesirable for the utility since its overall demand will be non-uniform for the same reasons.

SUMMARY OF THE INVENTION

In accordance with one aspect of the invention, the setback condition for auxiliary devices is not strictly duty cycle based but rather based on both the duty cycle and the cycle of the primary or HVAC setback program. That is, to the extent possible, the setback for the auxiliary devices is active during periods in which the setback condition for the HVAC system is inactive. In this way, a more uniform load to the utility is realized.

By another aspect of the invention, the auxiliary setback procedure is activated on the basis of both duty cycle and in coordination with the setback schedule of the HVAC (i.e. primary device). That is, the percentage of total time in which the setback condition is active can still be fulfilled, but the periods of on and off will not be equal in the manner as described hereinabove. Thus, the duty cycle requirements can still be met while making the load reduction more predictable.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
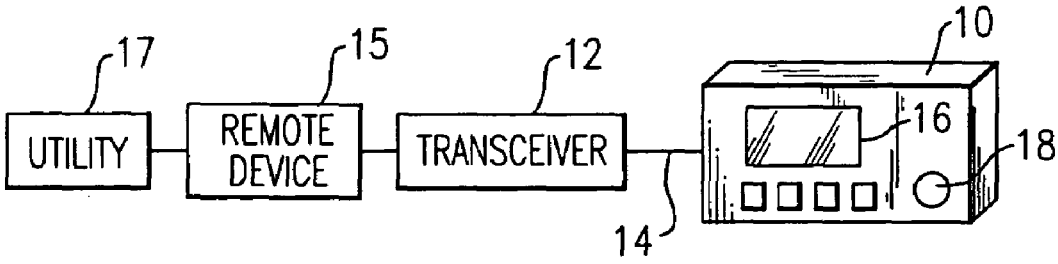
FIG.1 Prior Art
FIG. 1 is a schematic illustration of a thermostat and transceiver when the transceiver is in communication with a utility by way of a remote device.

Referring to FIG. 1, a control device or thermostat 10 is operatively connected to a transceiver 12 via a communication line 14, which may be wired or wireless, so as to receive from or transmit information to, the transceiver 12. The transceiver 12 provides a communication link between the thermostat 10 and remotely located device 15, which provides setpoint and auxiliary device control information to the thermostat 10. The remotely located device 15 is preferably controlled by an energy provider or utility 17 seeking to provide cost effective setpoint control information to the thermostat 10.

The thermostat 10 preferably causes messages to be displayed on a display 16 in response to receipt of information from the remotely located device 15 controlled by the utility 17. This includes the display of a message that the thermostat is in a setback mode of operation wherein the locally entered setpoint has been adjusted or altered in response to a request from the remotely located device 15. A touch sensitive button 18 on the front panel of the thermostat can be depressed at any time one wishes to override the setback mode of operation.

Figure 2:
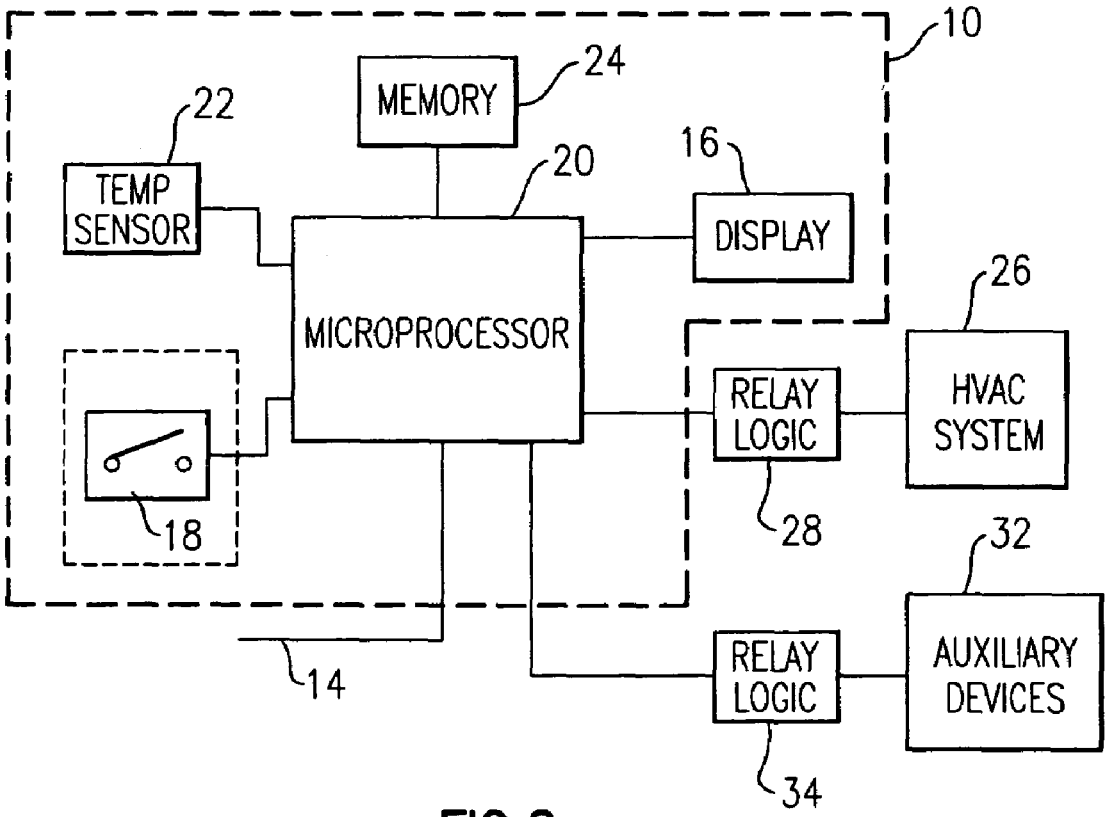
FIG. 2 is a schematic illustration of the elements within the thermostat including a microprocessor that is responsive to signals from the transceiver to control an HVAC system and auxiliary devices.

Referring to FIG. 2, the touch-sensitive button 18 is illustrated as a switch connected to a microprocessor 20 which is in turn connected to the display 16. The microprocessor 20 is also connected to a temperature sensor 22 and a memory 24. The microprocessor normally executes one or more control programs stored in memory 24, which monitor any variation of the temperature indicated by the sensor 22 with respect to one or more locally entered setpoints preferably stored in the memory 24. These control programs cause the microprocessor to control an HVAC system 26 (i.e. the primary device) through relay logic 28 so as to thereby heat or cool the space in which the thermostat is located as necessary. The HVAC system may include any or all of the components such as an air conditioner, a furnace or a fan coil and can be generally referred to as a comfort system.

The microprocessor 20 also executes a program stored in memory 24, which processes information received from the transceiver 12 via the line 14. This latter program, when executed by the microprocessor, will preferably implement adjustments to the locally entered setpoints that have been stored in the memory 24. It is, however, to be noted that this program may simply replace the locally entered setpoints without departing from the invention. The microprocessor will thereafter execute the one or more control programs stored in the memory 24 so as to monitor any variation of the temperature indicated by the temperature sensor 22 with respect to the now modified setpoints.

In addition to the HVAC system 26 being connected to the microprocessor 20 by way of relay logic 28, there are one or more auxiliary devices 32 that are also connected to the microprocessor 20 by way of relay logic 34. Examples of such auxiliary devices include pool pumps, pool heaters, hot water heaters, hot tubs, and the like. None of these devices include a thermostat of their own but rather are controlled by the microprocessor 20 of the thermostat 10 used for the HVAC system 26. Whereas these auxiliary devices may include temperature sensors for feeding back sensed temperature conditions to the microprocessor 20 such that the microprocessor 20 can then responsively turn on or turn off the individual auxiliary devices 32, a more common approach is to have an operator manually turn on or off the auxiliary devices on a selective basis.

Although possibly not as critical to the peak power usage as the HVAC system, the auxiliary devices 32 are recognized as contributing to the problem since they are likely to be turned on during periods of peak power usage. Accordingly, it is desirable to also operate those devices in a setback condition. Here, since no thermostat is included, it is not the thermostat set point that is setback but rather the time in which the device(s) are in operation. Thus, during periods of high energy demand, the utility 17 would also send signals by way of the remote device 15, the transceiver 12 and the thermostat 10 such that the microprocessor 20 would duty cycle one or more of the auxiliary devices 32. The manner in which this is accomplished will be described hereinafter.

Figure 3:
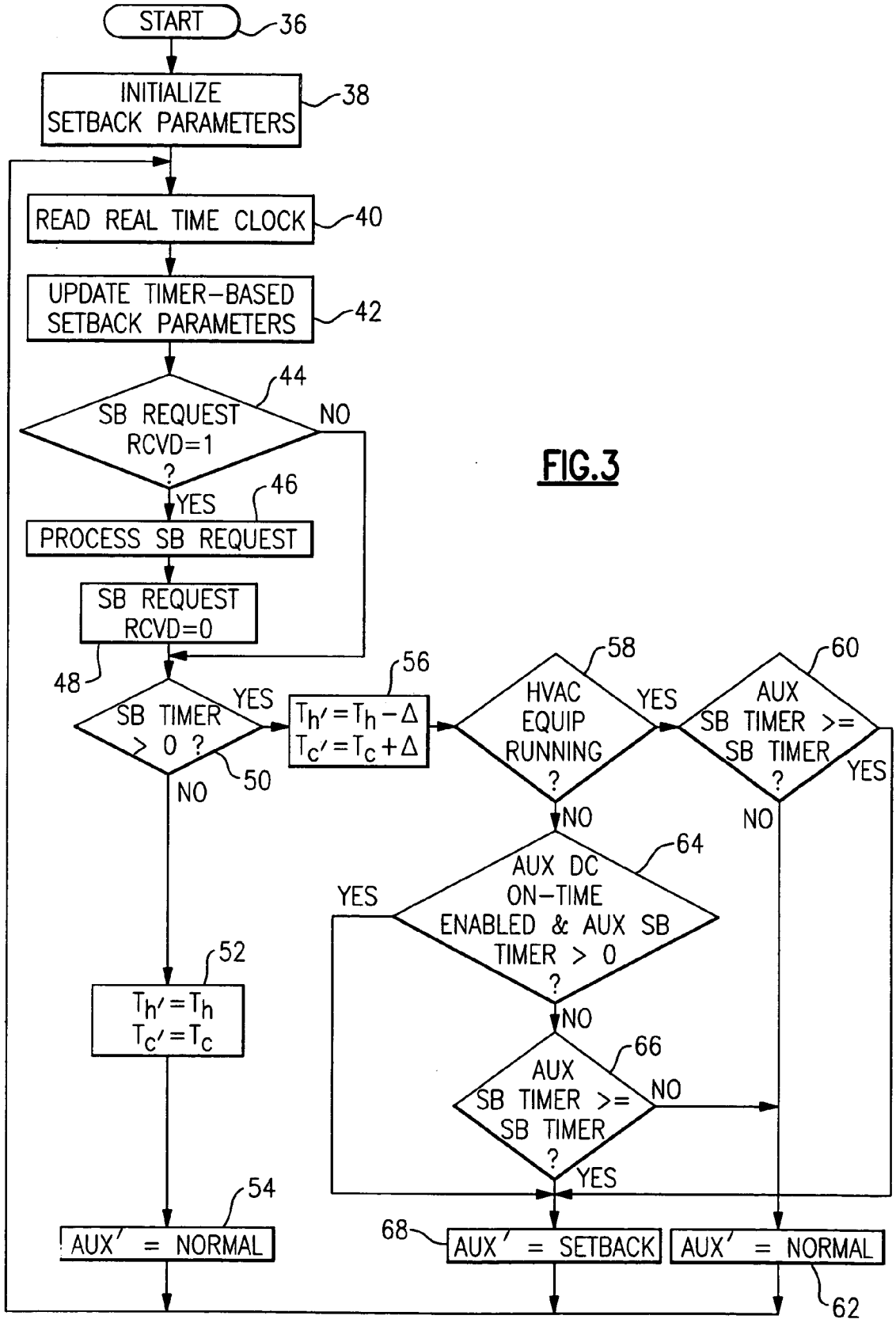
FIG. 3 is a flow chart showing the method in accordance with one embodiment of the present invention.

Referring now to FIG. 3, a flow chart is shown to illustrate a method of controlling the respective setback operations of both the HVAC systems 26 and the auxiliary devices 32 in accordance with one aspect of the invention.

The program is started at block 36 and a one time, or possibly seasonal, step is taken at block 38 to establish the setback parameters of both the HVAC system 26 and the auxiliary devices 32. The remaining portion of the flow chart is a repetitive procedure which occurs as a function of time and as a function of the setback parameters that are entered in block 38.

In block 40, the real time is read, and in block 42, the setback parameters that have been entered may be updated on the basis of the time. At block 44, the microprocessor inquires as to whether there is a setback request from the utility 17. If there is a request, it is processed at block 46 until such time as there is no longer a request or the request has been satisfied as shown at block 48.

At block 50 the microprocessor inquires as to whether the setback timer is set at a number greater than 0. If not, then the process proceeds to block 52 wherein the setpoint of the thermostat remains the same (i.e. there is no setback occurrence). For example, for heating, the new temperature setpoint $t_h'$ equals the old temperature setpoint $t_h$, and for cooling, the new temperature setpoint $t_c'$ equals the old temperature setpoint $t_c$. Further, as shown in block 54 the auxiliary devices operate normally without any setback condition such that they operate at all times that they are in the on condition, for example.

If, in block 50, it is determined that the setback timer is set at a time greater than 0, a setback condition exists as indicated at block 56. Here, new setpoints are established on the basis of the setback parameters as established in block 38. For example, a typical setback parameter for HVAC containment might be two degrees for two hours. Thus, for a period of two hours, the heating setpoint will be reduced by two degrees and the cooling setpoint will be increased by two degrees. Thus, for the heating mode, the new temperature setpoint $t_h'$ would be 68° F. if the old setpoint $t_h$ were 70° F. Similarly, for cooling, the new setpoint $t_c'$ would be 84° if the old setpoint $t_c$ were 82° F.

Assuming then that the system is operating in a setback condition as indicated in block 56, the microprocessor 20 queries whether the HVAC equipment is running as shown at block 58. If it is running, then the method proceeds to block 60 wherein the microprocessor 20 queries as to whether the auxiliary setback timer is greater or equal to the HVAC system setback timer. The purpose here is to make sure that the auxiliary devices 42 are not overly curtailed. Thus, if the auxiliary setback timer is not greater or equal to the setback timer for the HVAC system, then we pass to block 62 wherein the auxiliary devices 32 are operated normally without any setback condition occurring.

If in block 58 it is determined that the HVAC equipment is not running, then we proceed to block 64 wherein it is determined whether the auxiliary duty cycle on time is enabled and the auxiliary setback timer is greater than 0. If not, we pass to block 66, which is similar to block 60 wherein the system is queried as to whether the auxiliary setback timer is greater or equals the setback timer of the HVAC system. If not, then we pass to block 62 wherein the auxiliary devices are operated normally without a setback. If, in block 66, it is determined that the auxiliary setback timer is greater or equals the time set for the setback timer for the HVAC system 26, then we proceed to block 68 wherein the auxiliary devices 32 operate in their setback conditions.

Figure 4A:
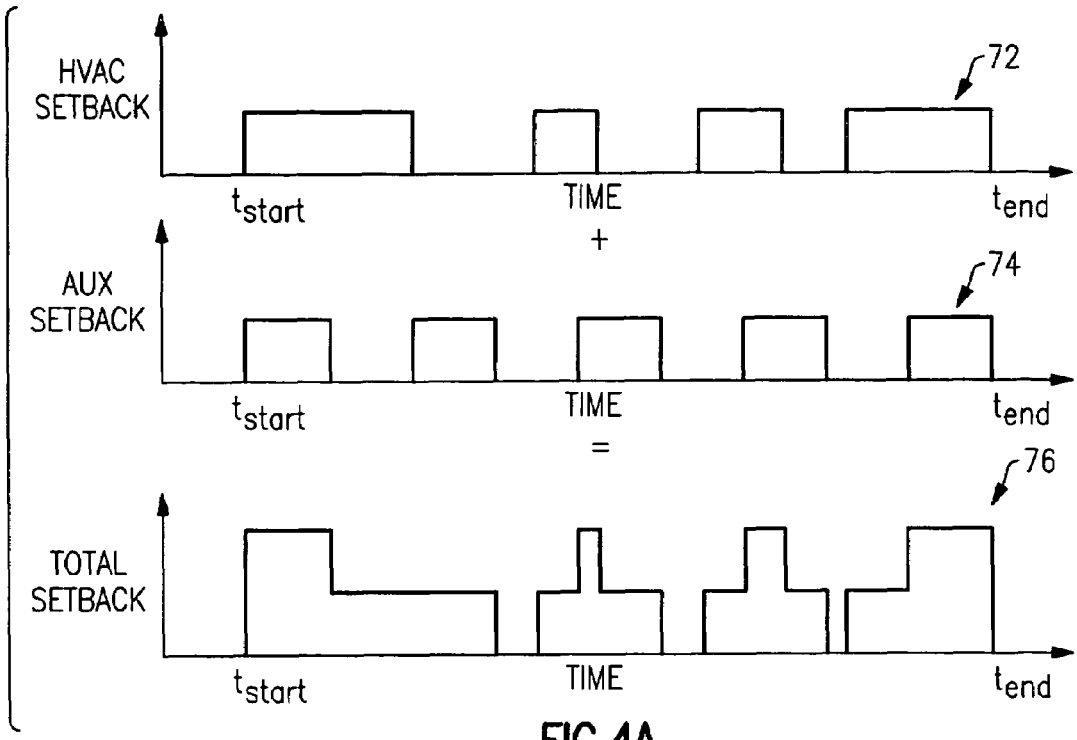
FIG. 4A is a schematic illustration of the setback schedules of both the HVAC system and auxiliary devices in accordance with the prior art.
Figure 4B:
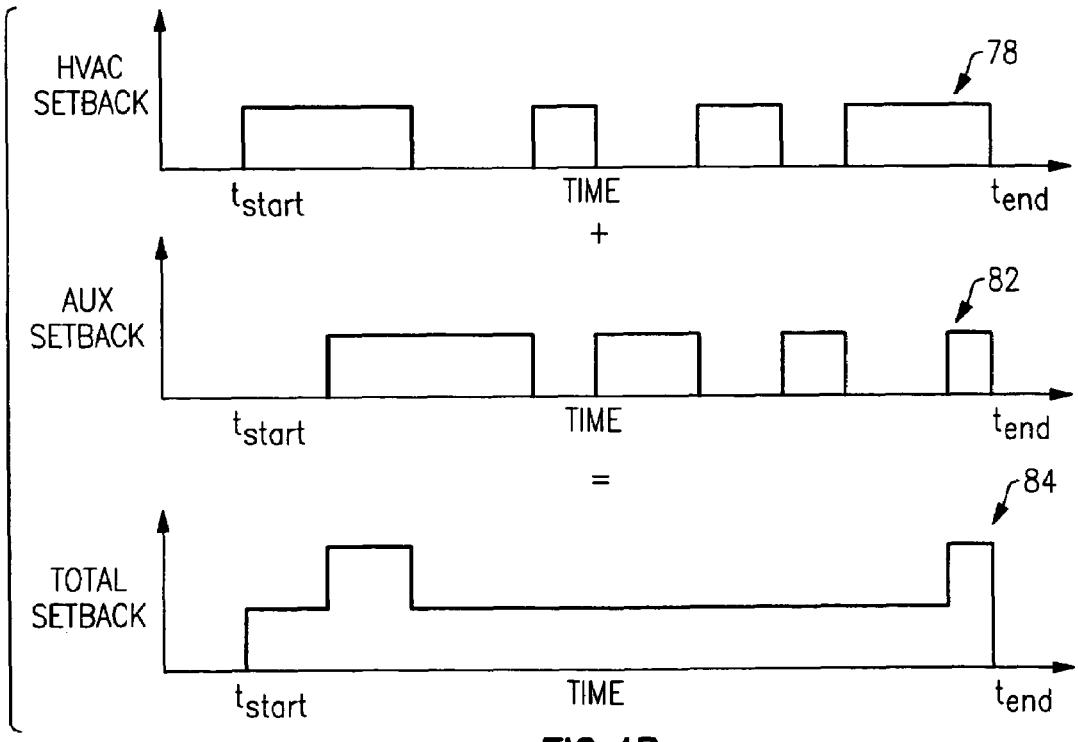
FIG. 4B is a schematic illustration of the setback schedules of both the HVAC and the auxiliary devices in accordance with an embodiment of the present invention.

To understand the significance of the coordination between the HVAC setback and the setback for the auxiliary devices, reference is made to FIGS. 4A and 4B.

As will be seen in the graph 72 of FIG. 4A, the blocks above the abscissa represent the time in which the HVAC setback is activated. It is strictly demand based, i.e. activated only during periods in which the utility orders it to be activated. Accordingly, while it may be uniform in the time period in which it is on or off, it is more likely to be non-uniform as shown.

In graph 74 of FIG. 4A, the time in which the auxiliary devices are in the setback are shown. Here, the on time is strictly duty cycle based, and the times for on and off operation are all generally equal.

Finally, in graph 76 of FIG. 4A, a combination of the two other graphs are shown to indicate the sum of the two. As will be seen, the result is very non-uniform in that there are portions of time when both are activated, there are times when only one is activated, and there are times when neither is activated. Thus, it will be seen that the load reduction is very non-uniform and inconsistent which is undesirable for the utility.

Shown in FIG. 4B are the same types of graphs indicating the on times for both the HVAC setback system and the auxiliary setback system, together with the summation thereof. As will be seen, graph 78 is substantially identical to graph 72 of FIG. 4A. Graph 82, on the other hand, is substantially different from graph 74 since the on and off times are non-uniform. This is a result of load balancing wherein the HVAC setback times and the auxiliary device setback times are coordinated such that, generally, the auxiliary setback system is activated when the HVAC setback system is deactivated to thereby balance the load. That is, as will be seen in graph 84, except for the spikes near the beginning and at the end of the cycle, the load reduction is uniformly distributed across the cycle.

Referring back to graph 82, it will be seen that the auxiliary setback can still be duty cycled based, in that over the entire cycle, the ratio of time on to time off can still be controlled. For example, both the graph at 74 and that at 82 are generally a 50% duty cycle. However, within that framework, an effort is made to also recognize when the HVAC setback is on and off and to balance that time by having coordinating off and on times of the auxiliary setback systems.

Referring again to graph 84 of FIG. 4B, wherein it is desirable to obtain a uniform total output as shown by the middle portion of the graph, it is also recognized that there may be times where, because of a particular type of auxiliary device and its use, the importance of operating the device in the normal mode is more important than the load balancing as discussed hereinabove. Accordingly, there may be times as shown by the two spikes in FIG. 4B wherein the desired load balancing will not result.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A method of controlling the operation of a hybrid system that includes both a primary and at least one auxiliary device, both the primary and auxiliary devices being powered by a utility which is in communication with both the primary and auxiliary devices to selectively initiate respective setback operations thereof, comprising the steps of:

sending respective setback signals from the utility to both the primary and auxiliary devices to initiate respective setback conditions; and determining the periods of time when the primary device is not operating in a setback condition and operating said auxiliary device in a setback condition during such periods.

2. A method as set forth in claim 1 wherein the step of operating said at least one auxiliary device in a setback condition is accomplished in a manner that also considers the duty cycle of the setback condition.

3. A method as set forth in claim 1 wherein said primary device is a comfort system.

4. A method as set forth in claim 1 wherein said at least one auxiliary device includes a plurality of devices selected from the group consisting of a pool pump, a pool heater, a hot water heater, and a hot tub.

5. A method as set forth in claim 1 wherein the step of sending respective setback signals is accomplished by way of a transceiver.

6. A method of balancing a load to a utility providing power to a primary and an auxiliary device with each device having a setback capability for temporarily reducing the power received from the utility, comprising the steps of:

periodically operating the primary device alternately in setback and non-setback conditions and operating the auxiliary device in opposite alternate non-setback and setback conditions such that the auxiliary device is operated in a setback condition when the primary device is operated in a non-setback condition, and the auxiliary device is operating in a non-setback condition when the primary device is operated in a setback condition.

7. A method as set forth in claim 6 and including the step of providing communication between the utility and the primary and auxiliary devices to selectively initiate the respective setback conditions.

8. A method as set forth in claim 7 wherein said communication providing step is accomplished by way of a transceiver.

9. A method as set forth in claim 6 wherein said primary device is a comfort system.

10. A method as set forth in claim 9 wherein a thermostat is included and the step of operating the primary device in a setback condition temporarily changes the setpoint of the thermostat.

11. A control system for managing the operation of a primary and at least one auxiliary device, with both said primary and said at least one auxiliary having the capability of being operated in a setback mode, comprising:

primary setback means for alternately initiating and terminating a setback condition of operation for the primary device; and an auxiliary setback means responsive to said primary setback means to alternately terminate and initiate a setback mode of operation for the at least one auxiliary device such that the auxiliary device is operating in a setback mode when the primary device is operated in a non-setback mode and the auxiliary device is operating in a non-setback mode when the primary devices is operated in a setback mode.

12. A control system as set forth in claim 11 and including receiving means for receiving setback parameters for both the primary and the at least one auxiliary device.

13. A control system as set forth in claim 12 wherein said receiving means includes a transceiver.

14. A control system as set forth in claim 12 wherein said receiving means includes a microprocessor.

15. A control system as set forth in claim 11 wherein said primary device is a comfort system.

16. A control system as set forth in claim 15 wherein said comfort system includes a thermostat having a setpoint.

* * * * *